US008216022B2

(12) United States Patent
Cavosie

(10) Patent No.: US 8,216,022 B2
(45) Date of Patent: Jul. 10, 2012

(54) CONNECTABLE WRAP BRA

(75) Inventor: Tara J. Cavosie, Loudonville, NY (US)

(73) Assignee: Tara J. Cavosie, Loudonville, NY (US)

( * ) Notice: Subject to any disclaimer, the term of this patent is extended or adjusted under 35 U.S.C. 154(b) by 134 days.

(21) Appl. No.: 12/479,792

(22) Filed: Jun. 6, 2009

(65) Prior Publication Data

US 2010/0081359 A1 Apr. 1, 2010

(51) Int. Cl.
*A41C 3/00* (2006.01)

(52) U.S. Cl. ..... 450/58; 450/88

(58) Field of Classification Search ..... 450/82, 450/88, 86, 17, 18, 23, 25, 26, 28, 63, 71, 450/77, 79, 58, 1; 2/67, 69
See application file for complete search history.

(56) References Cited

U.S. PATENT DOCUMENTS 3,826,266 A * 7/1974 Alpert ..... 450/11
4,411,269 A * 10/1983 Weintraub ..... 450/58
6,231,424 B1 * 5/2001 Valentin ..... 450/81
6,257,952 B1 * 7/2001 Valentin ..... 450/81
6,383,055 B2 * 5/2002 Valentin ..... 450/81
6,994,606 B2 * 2/2006 Li ..... 450/82
7,658,408 B2 * 2/2010 Zofchak et al. ..... 280/743.2
7,677,952 B2 * 3/2010 Wooley ..... 450/81

* cited by examiner

*Primary Examiner* — Gloria Hale
(74) *Attorney, Agent, or Firm* — Darrell L. Pogue; Keohane & D'Alessandro PLLC

(57) ABSTRACT

This disclosure provides a bra features a band with cups attached at each end. It secures to the user by stretching the band across the user's back and pulling the cups around to the front of the body. At this point, the bra is secured at the center bridge using connectors such that the cups will be connected to one another along their inner sides proximate the center of the wearer's chest. From the user's standpoint, the cups are positioned such that the right hand cup will hold the right breast, and the left hand cup will hold the left breast. In positioning the bra, under-support portions of the band will be positioned beneath each breast (e.g., a right under-support will be positioned under the right breast, and a left under-support will be positioned under the left breast. The bra is further secured by securing tabs (e.g., via any way now known or later developed such as adhesive, tape, hooks and eyes, hook and loop, etc.) located on outer sides of the cup, to the band.

10 Claims, 5 Drawing Sheets

CONNECTABLE WRAP BRA

CROSS-REFERENCE TO RELATED APPLICATIONS

This application is related in some aspects to provisional patent application No. 60/916,361, filed on 7 May 2007, the entire contents of which are herein incorporated by reference; U.S. Pat. No. 6,231,424, filed on 1 Feb. 1999, the entire contents of which are herein incorporated by reference; U.S. Pat. No. 6,257,952, filed on 9 Aug. 2000, the entire contents of which are herein incorporated by reference; U.S. Pat. No. 6,383,055, filed on 24 May 2001, the entire contents of which are herein incorporated by reference; U.S. Design Pat. No. D478406, filed on 4 Feb. 2002, the entire contents of which are herein incorporated by reference; U.S. Design Pat. No. D470994, filed on 4 Feb. 2002, the entire contents of which are herein incorporated by reference; U.S. Design Pat. No. D525012, filed on 7 Apr. 2004, the entire contents of which are herein incorporated by reference; U.S. Design Pat. No. D539506, filed on 5 Oct. 2005, the entire contents of which are herein incorporated by reference; and U.S. Design Pat. No. D555329, filed on 29 Jan. 2007, the entire contents of which are herein incorporated by reference.

FIELD OF THE INVENTION

The present invention generally relates to clothing. Specifically, the present invention relates to a wrap bra in which the cups are connected to one another across a chest of a wearer.

SUMMARY OF THE INVENTION

This bra features a band with cups attached at each end. It secures to the user by stretching the band across the user's back and pulling the cups around to the front of the body. At this point, the bra is secured at the center bridge using connectors such that the cups will be connected to one another along their inner sides proximate the center of the wearer's chest. From the user's standpoint, the cups are positioned such that the right hand cup will hold the right breast, and the left hand cup will hold the left breast. In positioning the bra, under-support portions of the band will be positioned beneath each breast (e.g., a right under-support will be positioned under the right breast, and a left under-support will be positioned under the left breast. The bra is further secured by securing tabs (e.g., via any way now known or later developed such as adhesive, tape, hooks and eyes, hook and loop, etc.) located on outer sides of the cup, to the band.

One aspect of the present invention provides a method of donning a bra, comprising: wrapping a band having a left cup and a right cup connected thereto around a back of a wearer; connecting the left cup to the right cup using a set of connectors; and positioning the left cup to a left breast of a wearer and the right cup to a right breast of the wearer.

Another aspect of the present invention provides a connectable wrap bra, comprising: a band; a first cup located at a first end of the band; a second cup located at a second end of the band, the first end and the second end being at opposite ends of the band; and a set of connectors for connecting the first cup to the second cup.

BRIEF DESCRIPTION OF THE DRAWINGS

These and other features of this invention will be more readily understood from the following detailed description of the various aspects of the invention taken in conjunction with the accompanying drawings in which.

Figure 1:
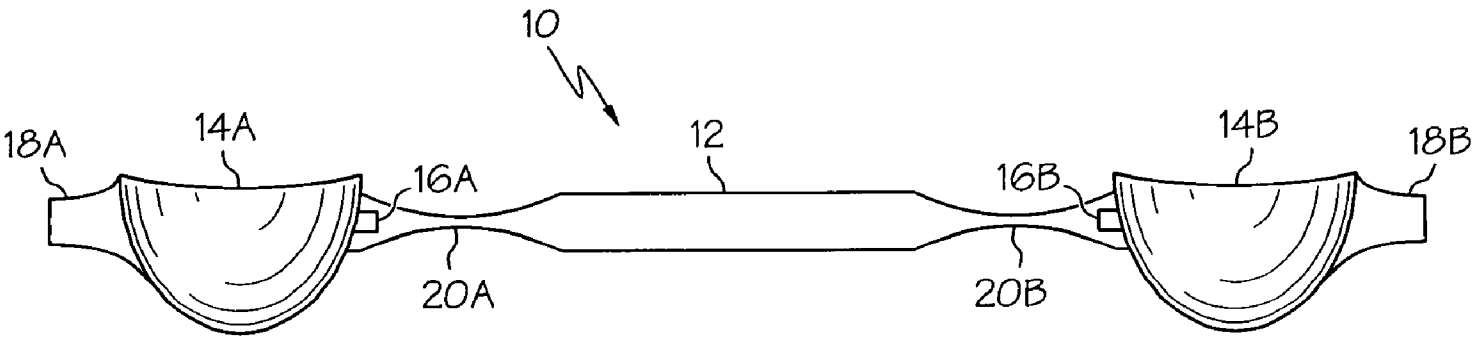
FIGS. 1-2 depicts a wrap bra according to an aspect of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

This bra features a band with cups attached at each end. It secures to the user by stretching the band across the user's back and pulling the cups around to the front of the body. At this point, the bra is secured at the center bridge using connectors such that the cups will be connected to one another along their inner sides proximate the center of the wearer's chest. From the user's standpoint, the cups are positioned such that the right hand cup will hold the right breast, and the left hand cup will hold the left breast. In positioning the bra, under-support portions of the band will be positioned beneath each breast (e.g., a right under-support will be positioned under the right breast, and a left under-support will be positioned under the left breast. The bra is further secured by securing tabs (e.g., via any way now known or later developed such as adhesive, tape, hooks and loops, hooks and eyes, etc.) located on outer sides of the cup, to the band.

Figure 2:
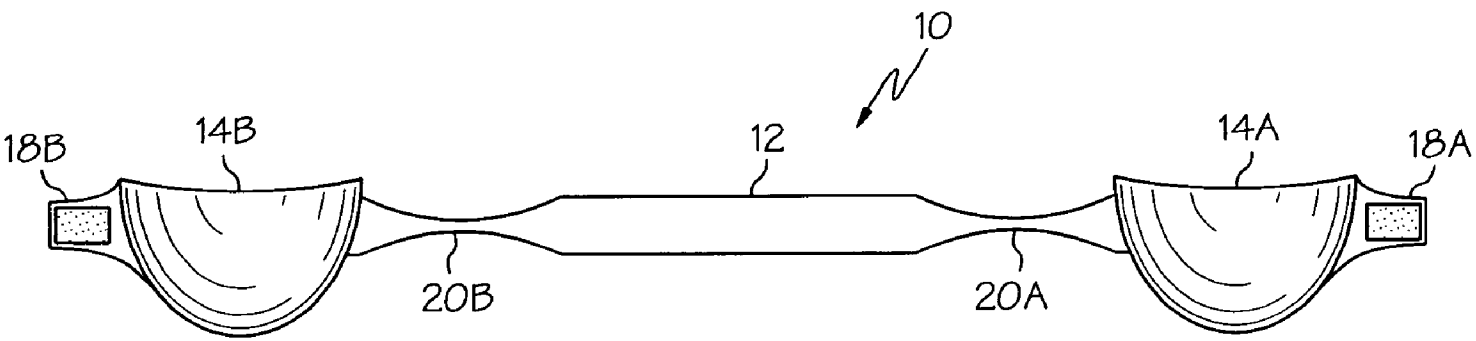

Referring now to FIGS. 1-2, a connectable wrap bra 10 according to an aspect of the present invention is shown. As depicted, connectable wrap bra 10 includes band 12, cups 14A-B (positioned at opposite ends of band 12), optional connectors 16A-B (not shown in FIG. 2), which can be any type of connection mechanisms now known or later developed such as (latches, hooks and eyes, clips, hooks and loops, etc.), side tabs 18A-B, and under-supports 20A-B (also referred to as under-support portions 20A-B of band 12). Bra 10 can be formed of any material suitable for a bra now known or later developed such as cotton, lace, silk, spandex, any combination thereof, etc. Bra 10 can be one continuous piece of materials. For example, side tabs 18A-B can be an extension of cups 14A-B or attachments to (e.g., sewn onto) cups 14A-B. Along these lines, bra 10 can be unitary (e.g., molded) unit. It should be understood that the quantity of components of any features of bra 10 can be varied for any reason (e.g., style, to accommodate different physical capabilities). For example, a different quantity of cups 14A-B, tabs 18A-B could be provided. It should also be understood that directional information (e.g., left cup vs. right cup) is provided for illustrative purposes only and that this will change depending on the viewpoint. As such, terms first and second are used and could each refer to any direction.

Figure 3:
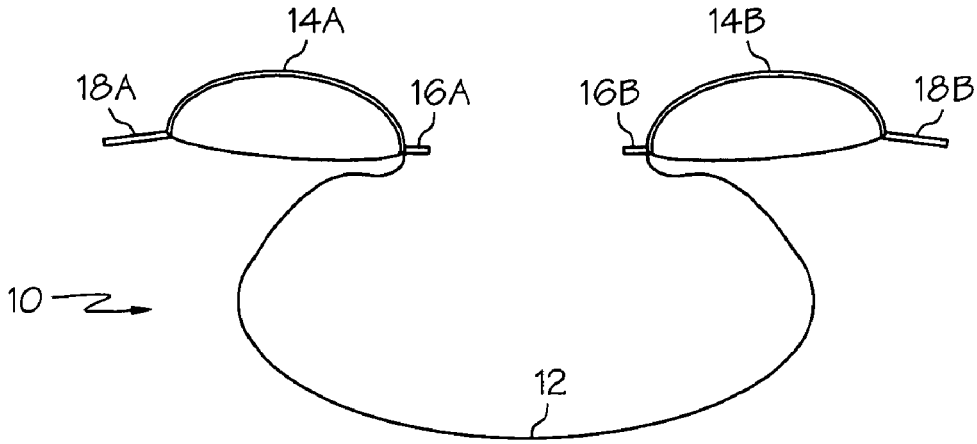
FIG. 3-4 depicts the wrap bra of FIGS. 1-2 as it would be donned by a wearer according to the present invention.
Figure 4:
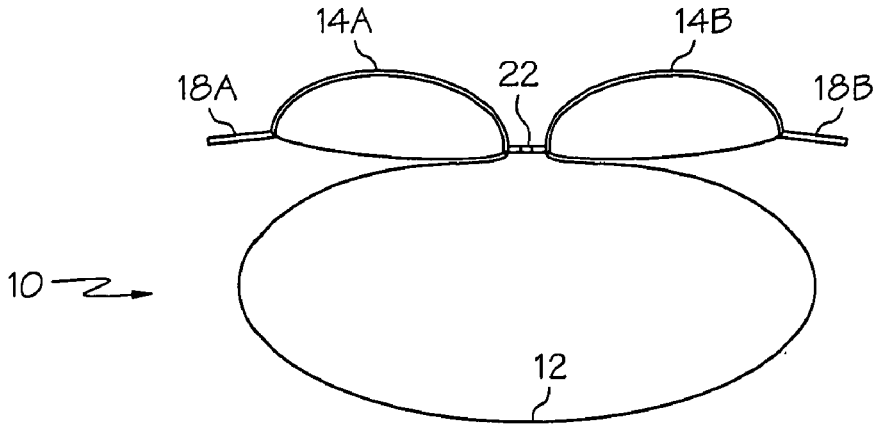

In general, as shown in FIGS. 3-4, connectable wrap bra 10 is donned by a user as follows: band 12 is wrapped around a back of a wearer so that cups 14A-B are adjacent the chest of wearer. The bra 10 can then be secured at the center bridge 22 by securing connections mechanisms 16A-B (hooks and eyes, hooks and loops, clips, etc.) located on inner sides of the cups 14A-B to one another.

Figure 5:
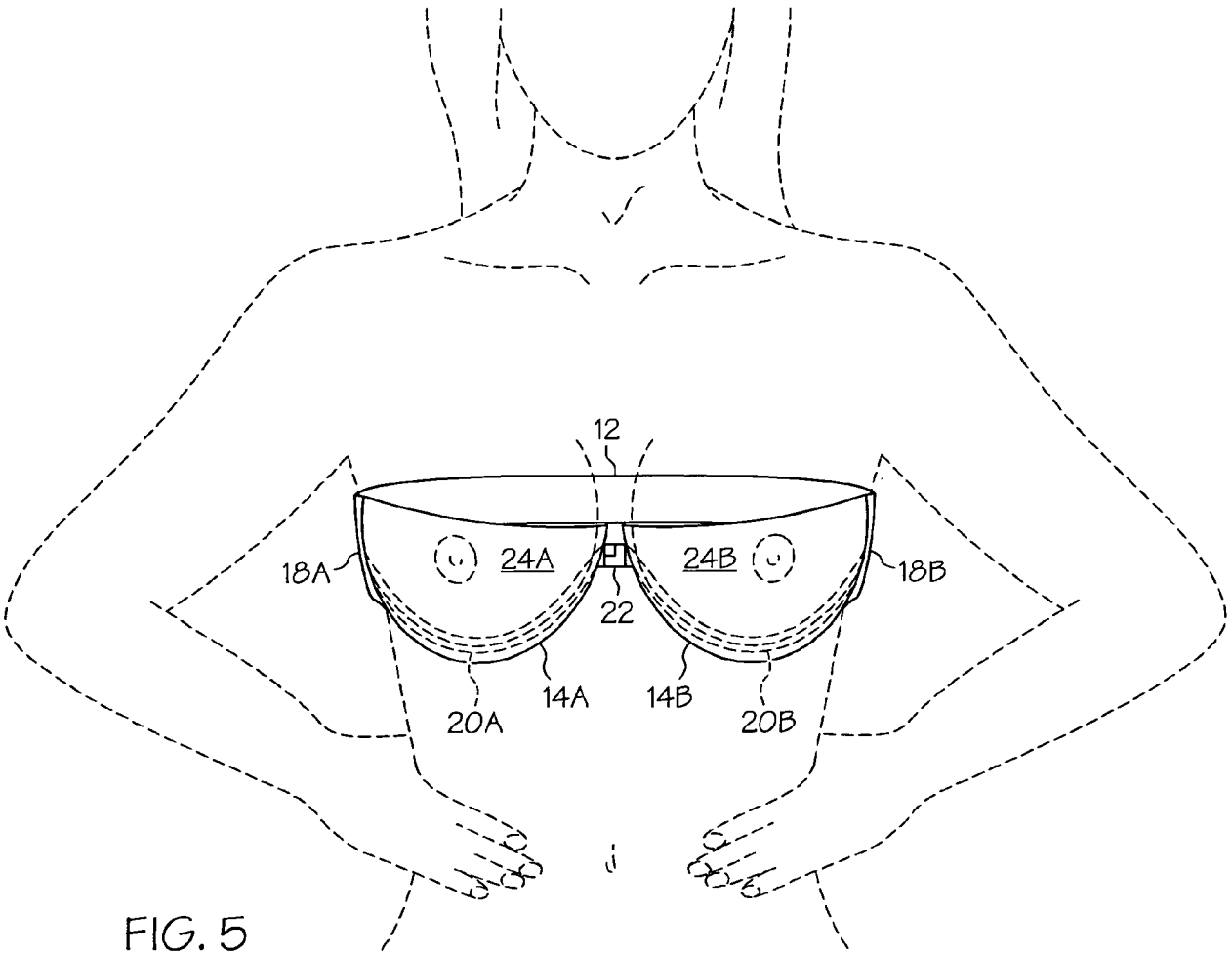
FIGS. 5-7 depict how the connectable wrap bra of FIGS. 1-4 might appear when donned by a wearer according to an aspect of the present invention.

At this point, from the wearer standpoint, the cups 14A-B are positioned/placed such that the left hand cup 14A will hold/cover a left breast, and the right hand cup 14B will hold/cover a right breast. In addition, under-supports 20A-B each will support and/or be positioned beneath a different breast of the wearer (i.e., there will be a one-to-one relationship between under-supports 20A-B and breasts). Specifically, as shown in FIG. 5, left under-support 20A will support/be positioned under left breast 24A, while right under-support 20B will support/be positioned under right breast 24B. To this extent, under-supports 20A-B appear to be next to cups 14A-B when bra 10 is open such as appearing in FIGS. 1 and 2. However, when bra is donned, such as in FIG. 5, under-supports 20A-B will be positioned between cups 14A-B and the wearer's body.

Figure 6:
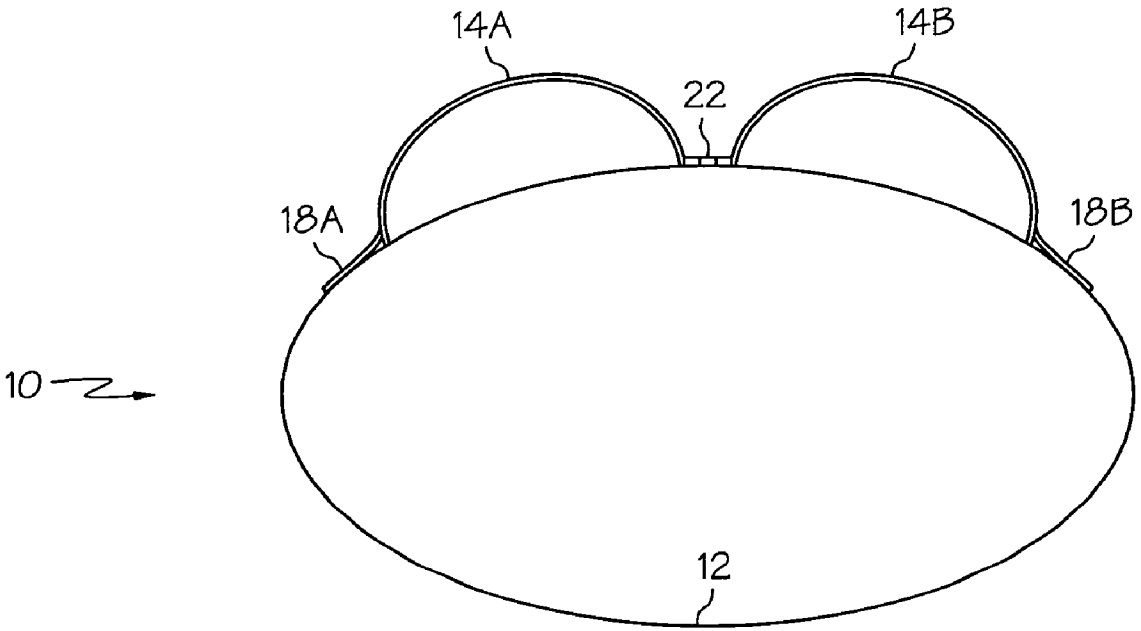
Figure 7:
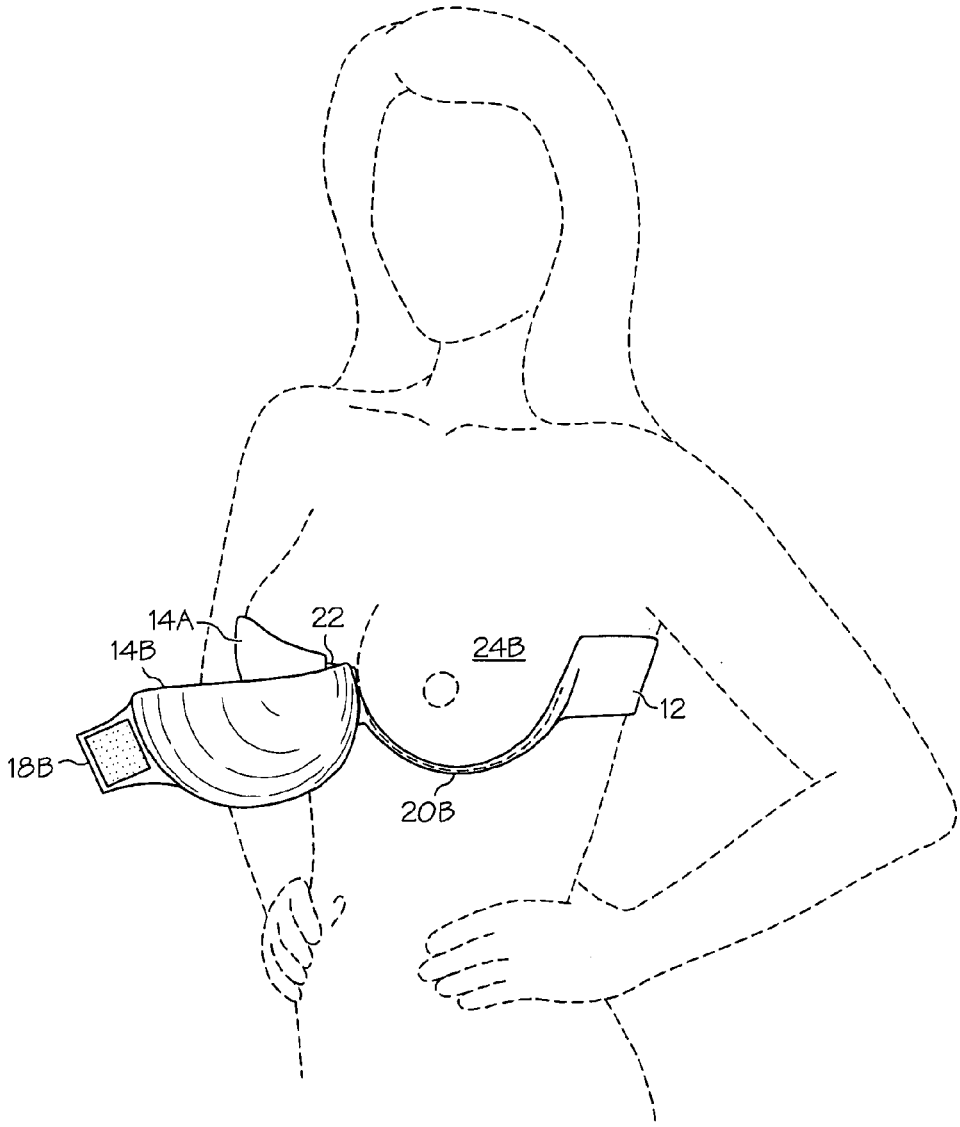

In addition, as shown in FIGS. 5-7, bra 10 can be further secured by securing/fastening side tabs 18A-B to band 12 as shown. Specifically, side tabs 18A-B are secured to band 12 (e.g., using any approach now known or later developed such as tape, adhesive, mechanical fastening mechanisms, hooks and eyes, hook and loop, etc.) in an area below a wear's armpit/underarm. Bra 10 can be made in a strapless version, as well as a version with straps that can be fixed, or removeably attached from/to any portion of bra 10.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

I claim:

1. A method of donning a bra, comprising:

wrapping a band of the bra having a first cup and a second cup connected thereto around a back of a wearer;

connecting the first cup to the second cup using a set of connectors; and positioning the second cup and the first cup over a chest of the wearer so that the first cup covers a first breast of the wearer and the second cup covers a second breast of the wearer, wherein the band is connected to an inner side of the first cup proximate a center of the chest of the wearer and positioned between the first breast of the wearer and the first cup, and the band is connected to an inner side of the second cup proximate the center of the chest of the wearer and positioned between the second breast of the wearer and the second cup.

2. The method of claim 1, the connecting comprising connecting an inner side of the first cup with an inner side of the second cup using the connector.

3. The method of claim 1, further comprising:

securing a first side tab positioned on an outer side of the first cup to the band; and securing a second side tab positioned on an outer side of the second cup to the band.

4. The method of claim 3, the first side tab securing to the band in an area below a first armpit of the wearer, the second side tab securing to the band in an area below a second armpit of the wearer.

5. The method of claim 1, further comprising:

positioning a first under-support under the first breast of the wearer, the first under-support being a portion of the band; and positioning a second under-support under the second breast of the wearer, the second under-support being a portion of the band.

6. A connectable wrap bra, comprising:

a band;

a first cup located at a first end of the band;

a second cup located and a second end of the band, the first end and the second end being on opposite ends of the band;

a first under-support portion of the band, and a second under-support portion of the band, the first under-support portion being connected to an inner side of the first cup proximate a center of the chest of the wearer and positioned between a breast of a wearer and the first cup, and the second under-support portion being connected to an inner side of the second cup proximate the center of the chest of the wearer and positioned between a breast of the wearer and the second cup; and a set of connectors for connecting the first cup to the second cup.

7. The connectable wrap bra of claim 6, the set of connectors being configured to connect an inner side of the first cup to an inner side of the second cup.

8. The connectable wrap bra of claim 6, further comprising:

a first side tab positioned on an outer side of the first cup; and a second side tab positioned on an outer side of the second cup.

9. The connectable wrap bra of claim 8, the first side tab being configured to attach to the band in an area below a first arm pit of a wearer, and the second side tab being configured to attach to the band in an area below a second arm pit of the wearer.

10. The connectable wrap bra of claim 6, the first under-support being positioned beneath a first breast of a wearer, and the second under-support being positioned beneath a second breast of the wearer.

* * * * *